United States Patent [19]

Narisoko et al.

[11] Patent Number: 4,708,067

[45] Date of Patent: Nov. 24, 1987

[54] METHOD OF CATALYSTLESS DENITRIFICATION FOR FLUIDIZED BED INCINERATORS

[75] Inventors: Minoru Narisoko, Matsudo; Satoshi Inoue, Asaka, both of Japan

[73] Assignee: Ishikawajima-Harima Heavy Industries Co., Ltd., Tokyo, Japan

[21] Appl. No.: 942,135

[22] Filed: Dec. 16, 1986

[30] Foreign Application Priority Data

Jan. 22, 1986 [JP] Japan ..... 61-10228

[51] Int. Cl.[4] ..... F23D 1/00; F23G 5/00

[52] U.S. Cl. ..... 110/245; 110/347; 122/4 D

[58] Field of Search ..... 110/245, 347; 122/4 D

[56] References Cited

U.S. PATENT DOCUMENTS

| | | | |
|---|---|---|---|
| 4,303,023 | 12/1981 | Perkins et al. | 110/245 |
| 4,411,879 | 10/1983 | Ehrlich et al. | 110/245 |
| 4,435,148 | 3/1984 | Moss | 110/245 |
| 4,446,799 | 5/1984 | Andersen | 110/245 |
| 4,474,119 | 10/1984 | Jones | 110/245 |
| 4,475,472 | 10/1984 | Adrian et al. | 110/347 |
| 4,499,857 | 2/1985 | Wormser | 122/4 D |
| 4,506,631 | 3/1985 | Phong-Anant | 110/245 |
| 4,555,996 | 12/1985 | Torbou et al. | 110/345 |
| 4,602,573 | 7/1986 | Tanca | 110/345 |

*Primary Examiner*—Henry C. Yuen

*Attorney, Agent, or Firm*—Cullen, Sloman, Cantor, Grauer, Scott & Rutherford

[57] ABSTRACT

A method of catalystless denitrification for a fluidized bed incinerator to remove NOx generated in burning refuse such as municipal wastes as the refuse is fluidized in a fluidized bed incinerator is disclosed. The refuse is fluidized together with fluidizing medium such as sand along with primary air, and is thermally decomposed and/or burned. The combustible gases generated by pyrolysis are burned with the secondary air blown into the incinerator in a lattice work arrangement. A denitrification agent is mixed in a part of the secondary air, and the NOx present in the combustion gas is removed without using catalysts.

4 Claims, 3 Drawing Figures

METHOD OF CATALYSTLESS DENITRIFICATION FOR FLUIDIZED BED INCINERATORS

BACKGROUND OF THE INVENTION

1. Field of the Invention

The present invention relates to a method on incinerating substances such as municipal wastes and industrial wastes (called "refuse" hereinafter) while fluidizing them in a fluidized bed. More particularly, the invention pertains to a method of denitrification without using catalysts in such refuse incinerators (called "catalystless denitrification" hereinafter) that is capable of decreasing the amount of nitrogen oxides (called "NOx" hereinafter) present in the combustion exhaust gas generated while incinerating the refuse in a fluidized bed.

2. Description of the Prior Art

Fluidized bed incinerators for disposing of refuse by incineration are known. The method of disposing of refuse in such a fluidized bed incinerator involves burning the refuse while fluidizing it with air, wherein a fluidizing medium such as sand (called "fluidizing medium" hereinafter) that aids in improving fluidization and combustion of refuse is fed to the bed along with the refuse.

Generally, fluidized bed incinerators are equipped with a plurality of air diffuser tubes or plates (called "air diffusers" hereinafter) in the lower part of the fluidized bed incinerator body (called "furnace body" hereinafter), as well as a refuse feeding mechanism and a fluidizing medium feeding mechanism in the upper part thereof.

The refuse and the fluidizing medium deposited onto the air diffuser tubes are fluidized by primary air blow from the air diffusers, and as they are fluidized, the refuse is burned.

The refuse may contain low calory refuse such as food discards or high calory refuse such as plastics. The refuse may comprise shredded paper or chipped furniture, fragmented metallic or vitreous containers, bottles, and cans, and other sundry substances. As the refuse is fed to the fluidized bed, the combustible portions thereof are burned. Refuse substances such as plastics undergo pyrolysis and therefore generate various pyrolysis, or thermal decomposition gases, while the incombustible portions such as metals and glasses are left unburned (called "combustion residue" hereinafter).

In the fluidized bed, a moving bed of the fluidizing medium is formed, and the medium particles descend as the feeding of the fluidizing medium continues. As a result, while the combustibles are burned or decomposed within the bed, the combustion residue is drawn downwardly along with the fluidizing medium and are removed from the furnace body through gaps between the air diffusers which are located in the lower part of the bed, where the fluidizing medium is separated from the combustion residue to allow the fluidizing medium to be recirculated back to the fluidized bed.

Secondary air is supplied to the freeboard part of the furnace body, i.e. that portion of the furnace body which extends above and over the fluidized bed (called "freeboard" hereinafter), wherein the generated pyrolysis gases are burned with the secondary air.

Since the fluidizing medium, e.g. sand, oscillates while it descends in the bed and is heated, it promotes agitation and dispersion of the refuse. Therefore, the refuse fed to the fluidized bed becomes uniformly dispersed under the presence of the fluidizing medium, and is dried, ignited, decomposed, and burned instantly. The airborne ash and dust generated in the furnace body are withdrawn from the upper part of the incinerator and are collected in an electric precipitator.

Thus, the refuse introduced into the fluidized bed is almost completely disposed of with the exception of metallic, vitreous, or ceramic residue, which is generally 2% of the refuse; this means that 98% of the refuse can be disposed of by a fluidized bed incinerator. That the combustion residue is only $\frac{1}{3}$ of that of a conventional mechanical incinerator such as the stroker type combustor is a primary advantage of the fluidized bed incinerator.

As shown in FIG. 3 of the accompanying drawings, however, some 100 ppm of NOx is contained in the combustion gas exhausted from fluidized beds. The prior art method of decreasing NOx consisted of leading the exhaust to a denitrification apparatus in which the NOx is removed, but this approach necessitates substantial additional equipment and results in the incinerator plant being large and complex.

SUMMARY OF THE INVENTION

Thus, it is the main object of this invention to provide a method of catalystless denitrification for a fluidized bed incinerator, wherein the NOx is removed within the furnace body without using catalysts from the exhaust combustion gas generated during the incineration of refuse.

It is another object of this invention to simplify fluidization and pyrolysis and/or combustion of the refuse within the fluidized bed and secondary combustion of the pyrolysis gas, while also simultaneously removing NOx.

In accordance with the present invention, the above objects are attained in a process comprising the steps of:

(a) forming a fluidized bed in an incinerator by fluidizing the refuse and the fluidizing medium supplied to the furnace body along with primary air;

(b) burning and/or thermally decomposing the refuse in the fluidized bed, such burning or decomposition resulting in the generation of combustion pyrolysis gas;

(c) burning the combustible gases generated by pyrolysis of the refuse by blowing secondary air into the freeboard portion of the furnace body above the fluidized bed; and (d) performing denitrification of the combustible gases by mixing a denitrification agent with the secondary air and reacting the agent with the nitrogen oxides present in the combustible gas.

DESCRIPTION OF THE PREFERRED EMBODIMENT

An example of the preferred embodiment of the method of catalystless denitrification for a fluidized bed incinerator of this invention will now be explained with references to the attached drawings.

Figure 1:
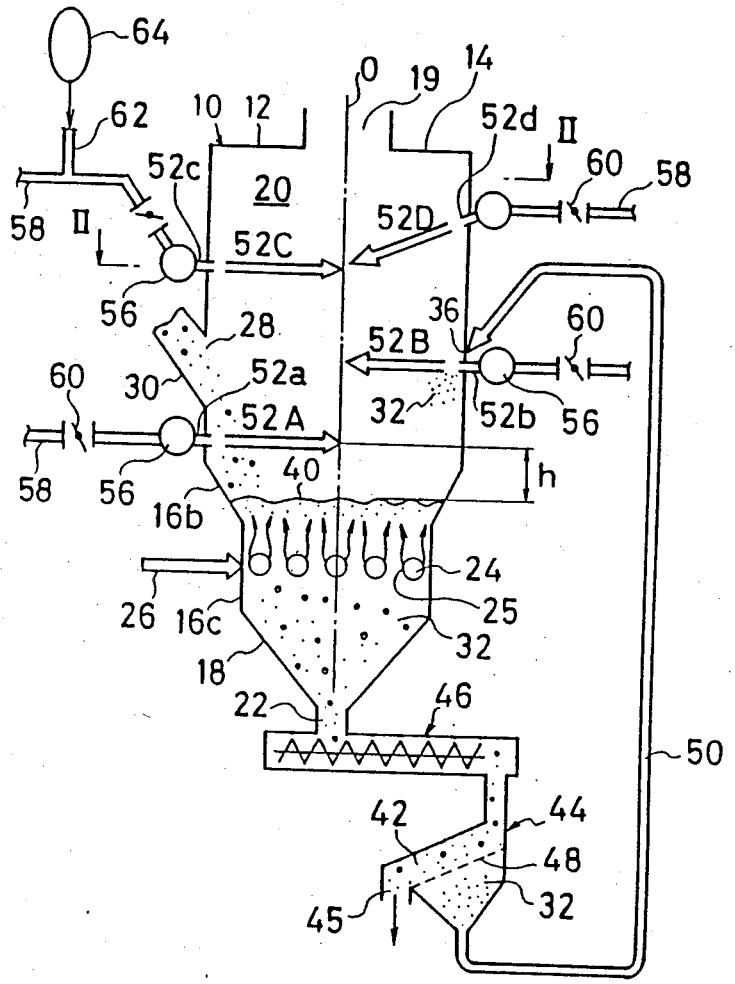
FIG. 1 is a schematic vertical sectional view, showing an example of the apparatus in which to practice the method of catalystless denitrification for a fluidized bed incinerator of this invention.

In FIG. 1, the reference number 10 designated a furnace body defined by refractory walls 12 comprising a rectangular top wall member 14, a side wall member 16, and an inverted rectangular pyramidal bottom wall member 18, which is connected to the side wall member 16 at its lower end. The side wall member 16 comprises an upper wall member 16*a*, in which a combustion chamber 20 (to be described later) is formed, an oblique side wall member 16*b*, whose walls incline inwardly from the upper wall member 16*a*, and a vertical side wall member 16*c*, which extends from the side wall member 16*b* to connect to the bottom wall member 18.

A gas exhaust port 19 is provided in the top wall member 14, and a solid discharge port 22 is provided in the center of the bottom wall member 18.

In the space enclosed by the vertical side wall member 16*c*, a large number of parallel air diffuser tubes 24 are provided to blow in primary air so as to form a fluidized bed in the furnace body 10. The tubes 24 extend through the side wall member 16*c* and out of the furnace body 10 to allow the tubes 25 to be connected to the fluidizing air charging tube 26. Nozzle holes 25 are provided on either side of the air diffuser tubes 24, at spaced intervals along their lengths.

A duct 30 through which the refuse 28 is deposited onto the air diffuser tubes 24 is connected to the upper side wall member 16*a* of the furnace body 10. The duct 30 is adapted to be connected to a refuse feeder (not shown).

In the upper wall member 16*a* there is formed a charging port 36 through which the fluidizing medium 32 can be fed to the furnace body 10. The fluidizing medium 32 is recirculated through the recirculation line 50.

The fluidizing air charging tube 26 is connected to an air source (not shown). Air from the tube 26 is delivered to each of the air diffuser tubes 24 and is blow through the nozzle holes 25, as shown in FIG. 1 by the arrows. A fluidized bed 40 is formed as the refuse 28 and the fluidizing medium are loaded onto the air diffuser tubes 24 and are fluidized by the air thus blown in.

A screw conveyor 46 is connected to the solid discharge port 22 of the furnace body 10 to transfer the fluidizing medium 32 and the combustion residue 42 of refuse 28 to a separator 44 as they flow down between the air diffuser tubes 24. The separator 44 is equipped with a sieve 48 which separates the combustion residue 42 from the fluidizing medium 32 in a manner such that the combustion residue 42 remains on the sieve 48 for discharge from the discharge port 45 of the separator 44, while the fluidizing medium 32 passes through the sieve 48 and is fed back to the fluidized bed 40 from the charging port 36 by means of the recirculation line 50, which may comprise, for example, a vertical conveyor that is fed by the separator 44.

In the vertical side wall member 16*c* that forms the combustion chamber 20 in the furnace body 10, a large number of nozzles 52 are deployed in an array made up of several (four in FIG. 1) vertically spaced stages of horizontal rows. The disposition of nozzles 52 is such that the lowermost stage comprising nozzle row 52*a* and the third stage comprising nozzle row 52*c* are on the same wall of the furnace body 10, while the second stage comprising nozzle row 52*b* and the fourth stage comprising nozzle row 52*d* are on the opposing wall.

Figure 2:
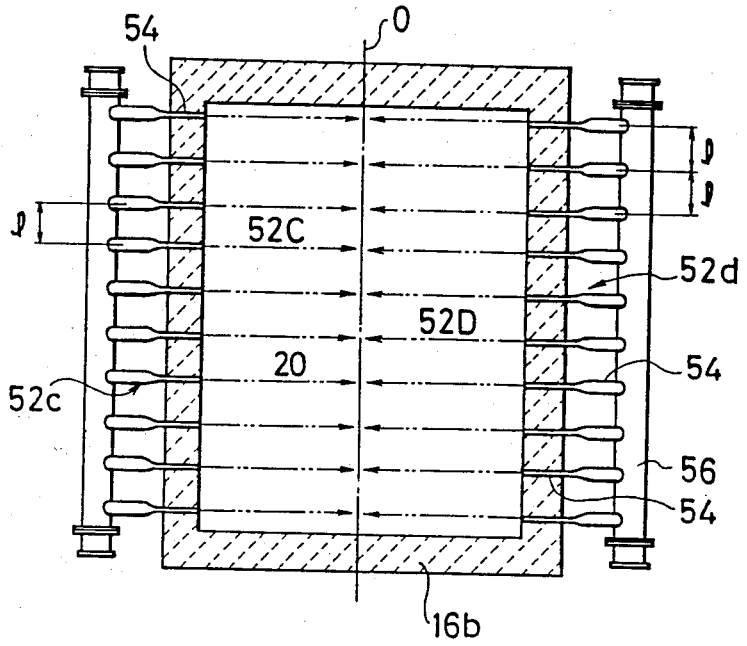
FIG. 2 is a plan view of the apparatus, showing the section through II—II in FIG. 1.
Figure 3:
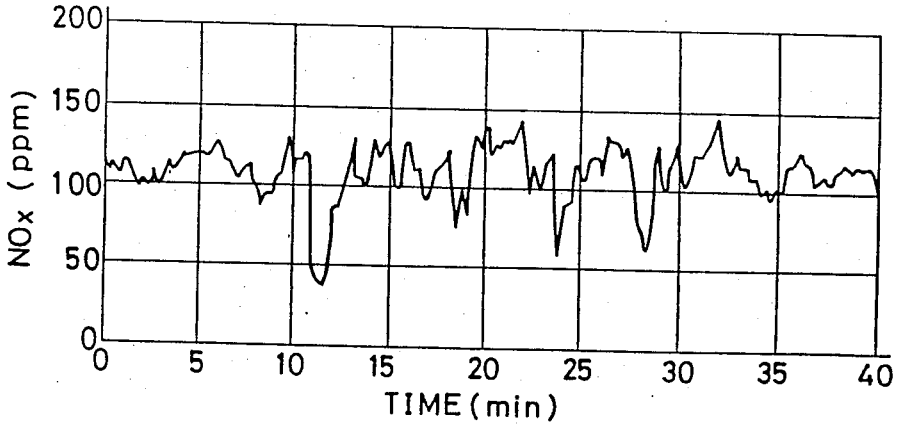
FIG. 3 is a diagram showing chronological changes in the NOx concentration in the exhaust gas coming out of a conventional fluidized bed incinerator.

These mutually opposing nozzles 52*a*–52*d* are oriented so as to generate secondary air streams directed inwardly toward the centerplane O of the furnace body 10, as shown by arrows 52A, 52B, 52C, and 52D in FIG. 1. Each of the nozzle rows 52 comprises a large number of individual nozzles 54, which are horizontally attached to an air manifold 56 as shown in FIG. 2, each nozzle extending through the side wall member 16*b* to open into the combustion chamber 20. The preferred range for the inner dimensions of each of the nozzles 54 is 40 to 80 mm in diameter where the nozzle 54 is circular in cross section or 30×60 mm to 40×100 mm where the nozzle 54 is rectangular in cross section, and the preferred range for the internozzle spacing 1 is 200 to 600 mm.

As shown in FIG. 1, connected to the air manifold 56 of each stage are secondary air charging tube 58 and a damper 60, which regulates the secondary air to a pressure of 2,500 mm Hg or more as it is supplied from the secondary air charging tube 58 to air manifold 56, so that each of the nozzles 54 will inject secondary air traversely across the combustion chamber 20 as shown by the double dot-dash lines in FIG. 2. The lowermost stage nozzle row 52*a* is positioned so that the air stream 52A therefrom will be from 0.1 to 1.5 meters above the fluidized bed 40.

A denitrification agent source 64 is connected through a connecting tube 62 to at least one of the secondary air charging tubes 58, each of which respectively delivers the secondary air to each of the nozzle rows 52*a*, 52*b*, 52*c*, and 52*d*. For example, the connecting tube 62 may be connected to the secondary air charging tube 58 that serves the third stage nozzle row 52*c*. The denitrification agent may be ammonia, urea, or the like, and the denitrification agent source 64 is capable of controlling the rate at which the denitrification agent is added to the secondary air in accordance with the concentration of NOx in the combustion gas generated.

The method of this invention of incinerating refuse in the incinerator described above in detail will now be discussed. Onto the air diffuser tubes 24 in the furnace body 10, there is deposited refuse 28 supplied by the refuse feeder (not shown) through the duct 30 and fluidizing medium 32 through the charging port 36 by means of the recirculation line 50. Fluidizing air is supplied to the air diffuser tubes 24 from the fluidizing air charging tube 26. The fluidizing air is blown in as primary air from the nozzle holes 25 of the air diffuser tubes 24, so that the refuse 28 and the fluidizing medium 32 that accumulate over the air diffuser tubes 24 are fluidized by the primary air blow in from the nozzles 25.

Though not shown in FIG. 1, there are provided within the furnace body 10, start-up burners, whose flames ignite the refuse 28 in the fluidized bed 40 in order to start-up the incinerator. Ignition by these burners is terminated when combustion of the refuse 28 in the fluidized bed 40 becomes self-sustained. The combustion becomes self-sustained when the flame formed on the fluidized bed 40 becomes spread all over the fluidized as a result of the air streams 52A, which are blown in from the lowermost stage nozzles 51*a* so as to form a lattice arrangement. The air streams 52A provide a means for controlling the flames of the fluidized bed 40 and for dispersing the pyrolysis gas uniformly. As used herein the term "burning" of the refuse shall include the thermal decomposition thereof as well.

A part of refuse 28 is subjected to pyrolysis by the heat of combustion of the refuse 28 itself. The resulting pyrolysis gas contains combustible gases such as hydrogen, carbon monoxide, and hydrocarbonaceous gases, which are subjected to secondary combustion in the freeboard part of the furnace body 10, which forms the combustion chamber 20, as a result of the secondary air blown in from nozzles 52. That is to say, the combustible gases are completely burned while ascending through the combustion chamber 20 with the secondary air streams 52B, 52C, and 52D that are blown in respectively from nozzles **52*b*, 52*c*, and 52*d*, each forming a lattice with an air velocity of over 50 m/sec. Since these secondary air streams 52B, 52C, and 52D traverse the combustion chamber 20 in the form of a lattice and thus cover the entire space of the combustion chamber 20 in several stages, the combustible gases from the fluidized bed 40 are forced to mix thoroughly with the secondary air and are burned in the whole volume of the combustion chamber 20** positively, quickly, and stably.

Since the secondary air streams 52C blown from the third stage nozzles **52*c* contain a denitrification agent such as ammonia supplied from the denitrification agent source 64, NOx in the combustion gas reacts with the agent and is reduced, thereby denitrifying the combustion gas. Effective contact between denitrification agent and NOx is ensured due to the secondary air 52C blowing in a lattice across the combustion chamber 20. Denitrification rates of about 40% or over can be achieved, and the NOx concentration in the exhaust gas can be reduced to 60 ppm or under. The exhaust gas thus denitrified is discharged through the exhaust port 19**. Since this exhaust gas contains a large quantity of heat, it may be used for preheating boiler water and the like, following which it is led to an electrostatic precipitator (not shown) which removes dust from the exhaust gas.

The refuse 28 and the fluidizing medium 32 are fed to the fluidized bed 40 in timed relationship, wherein the refuse is burned and/or decomposed as described above. The fluidizing medium 32, on the other hand, descends through the fluidizing bed 40, thereby forming a moving bed and promoting agitation and dispersion of the refuse 28. The fluidizing medium 32 then flows together with the combustion residue 42 of refuse 28 out of the fluidized bed 490 through the gaps between the air diffuser tubes 24 onto the bottom wall member 18, thence through the discharge port 22 to the screw conveyor 46, which delivers the mixture of the fluidizing medium 32 and the combustion residue 42 to the separator 44.

In the separator 44, the combustion residue 42 is separated by the sieve 48 from the fluidizing medium 32, which is returned to the fluidized bed 40 through the recirculation line 40, while the combustion residue 42 is discharged from the discharge port 45.

From the foregoing description it may be appreciated that the invention provides the following benefits:

1. Because the secondary air nozzles are deployed in several parallel rows stages vertically in the combustion chamber of the fluidized bed incinerator, the secondary air from these nozzles is blown traversely across the combustion chamber, and the denitrification agent is mixed with the secondary air form the nozzles of at least one stage, the secondary combustion of combustible gases and denitrification of combustion gas are both carried out extremely effectively.

2. Since denitrification is carried out within the fluidized bed incinerator, the cost of denitrification is reduced.

We claim:

1. A method of catalystless denitrification for a fluidized bed incinerator, comprising the steps of:

(a) forming a fluidized bed in the incinerator by fluidizing the substances to be incinerated and an incombustible fluidizing medium as the substances and the fluidizing medium are supplied to the fluidizing bed along with primary air, the primary air being blown into the fluidized bed by air diffuser tubes provided in the lower part of the incinerator, the air diffuser tubes extending generally parallel to each other;

(b) burning the substances in the fluidized bed, the burning of the substances resulting in the generation of combustible pyrolysis gases;

(c) forming a downward flow of the combination of the combustion residue of the substances to be incinerated and the fluidizing medium inside the fluidized bed through the air diffuser tubes, and discharging said combination from the bottom of said incinerator;

(d) separating the fluidizing medium from the combustion residue in a sieve, and then recirculating the separated fluidizing medium to the fluidized bed;

(e) combusting the combustible pyrolysis gases in the incinerator by blowing secondary air into a portion of the incinerator above the fluidized bed, the secondary air being blown into the portion of the incinerator from opposite sides of the incinerator along a plurality of parallel paths defining a lattice arrangement and from at least one upper stage and one lower stage in the incinerator; and, (f) performing denitrification of said combustible pyrolysis gas by mixing a gaseous denitrification agent with a portion of the secondary air which is introduced into the incinerator through said upper stage to react the agent with the nitrogen oxides present in the combustible pyrolysis gas within the incinerator.

2. The method of claim 1, wherein the incombustible fluidizing medium is sand, and wherein the combustion residue separated by the sieve and the sand serve to agitate the substances to be incinerated and thereby facilitate combustion.

3. The method of claim 1, wherein the gaseous denitrification agent is ammonia.

4. The method of claim 1, wherein the gaseous denitrification agent is urea water.

* * * * *